US011813772B2

(12) United States Patent
Chua et al.

(10) Patent No.: US 11,813,772 B2
(45) Date of Patent: Nov. 14, 2023

(54) CONCRETE CUTTING MACHINE AND SLIDING PLATE ASSEMBLY FOR A CONCRETE CUTTING MACHINE

(71) Applicant: Nanjing Chervon Industry Co., Ltd., Nanjing (CN)

(72) Inventors: Bun Hiong Chua, Nanjing (CN); Monteverde Richard, Nanjing (CN); Ran Lan, Nanjing (CN); Hua Zhang, Nanjing (CN); Meixiong Lai, Nanjiang (CN)

(73) Assignee: Nanjing Chervon Industry Co., Ltd., Nanjing (CN)

( * ) Notice: Subject to any disclaimer, the term of this patent is extended or adjusted under 35 U.S.C. 154(b) by 302 days.

(21) Appl. No.: 16/908,281

(22) Filed: Jun. 22, 2020

(65) Prior Publication Data

US 2020/0406503 A1 Dec. 31, 2020

(30) Foreign Application Priority Data

Jun. 26, 2019 (CN) ..... 201910557752
Jan. 23, 2020 (CN) ..... 202010076773
May 13, 2020 (CN) ..... 202010400775

(51) Int. Cl.
*B28D 1/04* (2006.01)
*E01C 23/02* (2006.01)
*E01C 23/09* (2006.01)

(52) U.S. Cl.
CPC ..... *B28D 1/045* (2013.01); *E01C 23/025* (2013.01); *E01C 23/0933* (2013.01)

(58) Field of Classification Search
CPC ..... E01C 23/025; E01C 23/0933; B28D 1/04; B28D 1/041; B28D 1/042; B28D 1/045; B28D 1/048
See application file for complete search history.

(56) References Cited

U.S. PATENT DOCUMENTS 2,996,089 A * 8/1961 McCarty ..... B27G 19/10 83/441.1
4,155,141 A * 5/1979 Guerra ..... E01C 19/44 15/235.8
4,903,680 A * 2/1990 Chiuminatta ..... B23Q 9/0014 30/373
5,579,753 A 12/1996 Chiuminatta et al.
6,112,736 A * 9/2000 Bearden ..... B23Q 9/0028 404/93

(Continued)

FOREIGN PATENT DOCUMENTS

CN 1230912 A 10/1999

*Primary Examiner* — Janine M Kreck
*Assistant Examiner* — Michael A Goodwin
(74) *Attorney, Agent, or Firm* — Greenberg Traurig, LLP

(57) ABSTRACT

A concrete cutting machine, for wet and dry dual-use cutting, includes a saw blade, which is configured to cut concrete, a motor, which is configured to drive the saw blade to rotate about a first axis, and a bottom plate, which is configured to support the motor and the saw blade. The bottom plate is formed with a first cutting space for the saw blade to pass through. The concrete cutting machine further includes a sliding plate assembly, which is at least partially disposed in the first cutting space, to form a second cutting space smaller than the first cutting space.

11 Claims, 19 Drawing Sheets

(56) References Cited

U.S. PATENT DOCUMENTS

| | | | | |
|---|---|---|---|---|
| 2003/0196648 | A1* | 10/2003 | Schroer | B23D 47/02 125/14 |
| 2016/0167252 | A1* | 6/2016 | Merck | B28D 7/02 15/303 |
| 2018/0071845 | A1* | 3/2018 | Hansen | B23D 59/006 |

* cited by examiner

CONCRETE CUTTING MACHINE AND SLIDING PLATE ASSEMBLY FOR A CONCRETE CUTTING MACHINE

RELATED APPLICATION INFORMATION

This application claims the benefit under 35 U.S.C. § 119(a) of Chinese Patent Application No. CN 201910557752.0, filed on Jun. 26, 2019, Chinese Patent Application No. CN 202010076773.3, filed on Jan. 23, 2020, and Chinese Patent Application No. CN 202010400775.3, filed on May 13, 2020, each of which is incorporated herein by reference in its entirety.

TECHNICAL FIELD

The present invention relates to the field of power tools, in particular to a concrete cutting machine and a sliding plate assembly for a concrete cutting machine.

BACKGROUND

Two types of cutting machines for cutting concrete are included for cutting full-dry concrete and green concrete. At present, a few cutting machines for cutting green concrete exist on the market. Such cutting machine has a sliding plate assembly for being in contact with the concrete surface, a saw blade passes through the sliding plate assembly to perform cutting, and the sliding plate assembly is mounted to a bottom plate. At present, mostly the sliding plate assembly is mounted to the concrete cutting machine in a direction perpendicular to the ground, which may cause inconvenience or inaccuracy in assembly and disassembly of the sliding plate assembly.

SUMMARY

In one disclosed example, a concrete cutting machine includes a saw blade configured to cut concrete; a motor configured to drive the saw blade to rotate about a first axis; a bottom plate configured to support the motor and the saw blade, wherein the bottom plate is formed with a first cutting space for the saw blade to pass through; and a sliding plate assembly, which is at least partially disposed in the first cutting space to form a second cutting space smaller than the first cutting space; wherein the sliding plate assembly is detachably mounted to the bottom plate and is movable relative to the bottom plate within a preset range in a first direction parallel to the first axis.

In a further example, a concrete cutting machine includes a motor configured to drive a saw blade to rotate about a first axis; a bottom plate configured to support the motor, wherein the bottom plate is formed with a first cutting space for the saw blade to pass through; and a sliding plate assembly comprising a flattening member provided with a flattening surface for contacting with concrete, wherein the flattening surface is parallel to the first axis and the flattening member is provided with a second cutting space for the saw blade to pass through; wherein the sliding plate assembly is detachably mounted to the bottom plate, and the flattening surface is located below the bottom plate in a direction perpendicular to the flattening surface.

In a further example, a sliding plate assembly for a concrete cutting machine includes a supporting member connected to the concrete cutting machine; a flattening member connected to the supporting member; and a mounting assembly configured to detachably mount the supporting member to the concrete cutting machine; wherein the flattening member is provided a flattening surface for contacting with concrete, and the flattening surface is located below the supporting member in a direction perpendicular to the flattening surface.

DETAILED DESCRIPTION

The concrete cutting machine is a hand-push type cutting machine, which can be used for cutting full-dry concrete and green concrete. The full-dry concrete here refers to common dry and hard concrete, and the green concrete refers to concrete in a green state with a higher water content than the full-dry concrete and smaller strength and hardness than the full-dry concrete. When the green concrete is hardened to a certain degree to be cut, a user will hardly leave a footprint when stepping on the surface of the concrete.

Figure 1:
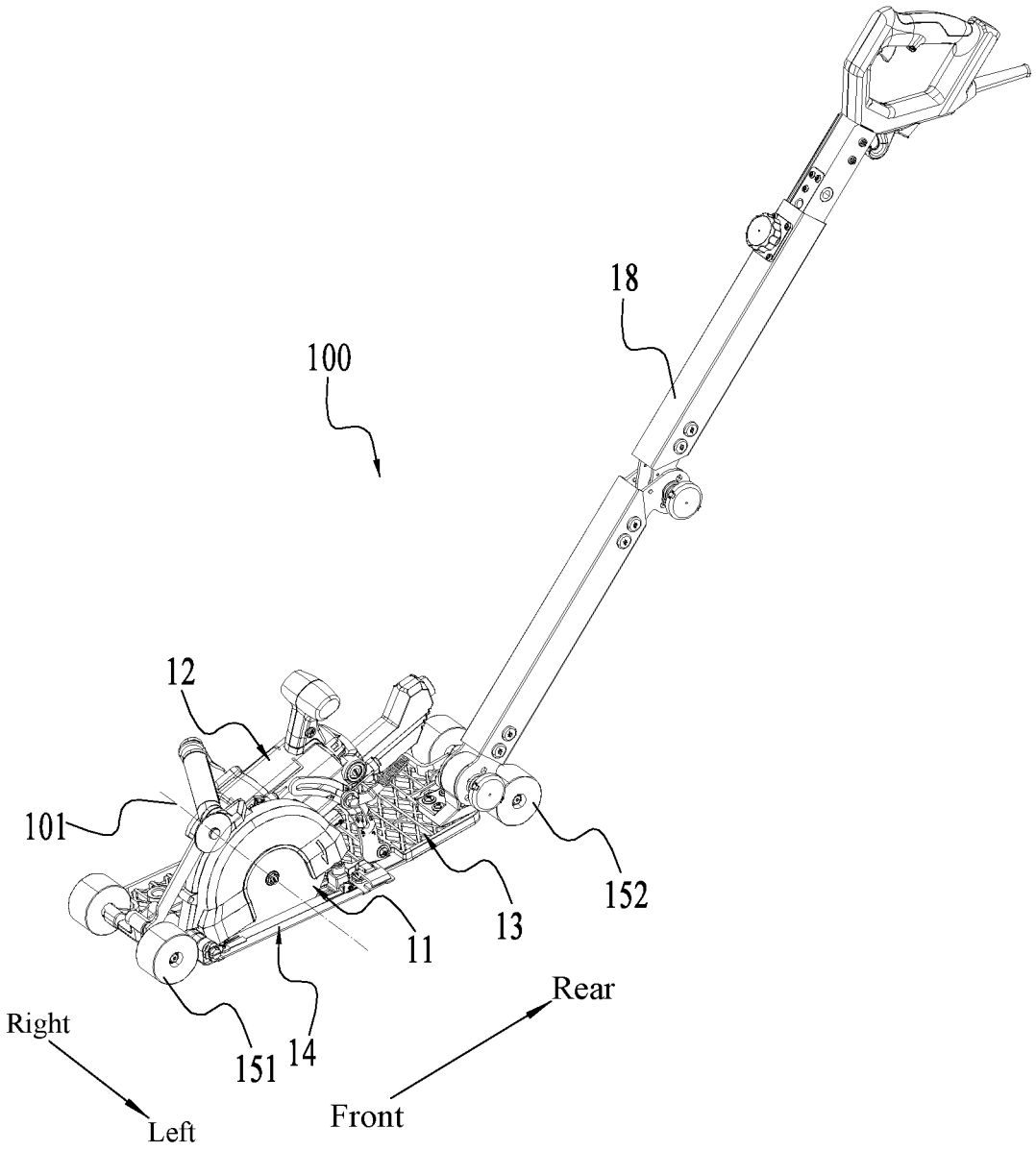
FIG. 1 is a schematic view of a concrete cutting machine according to a first example.
Figure 2:
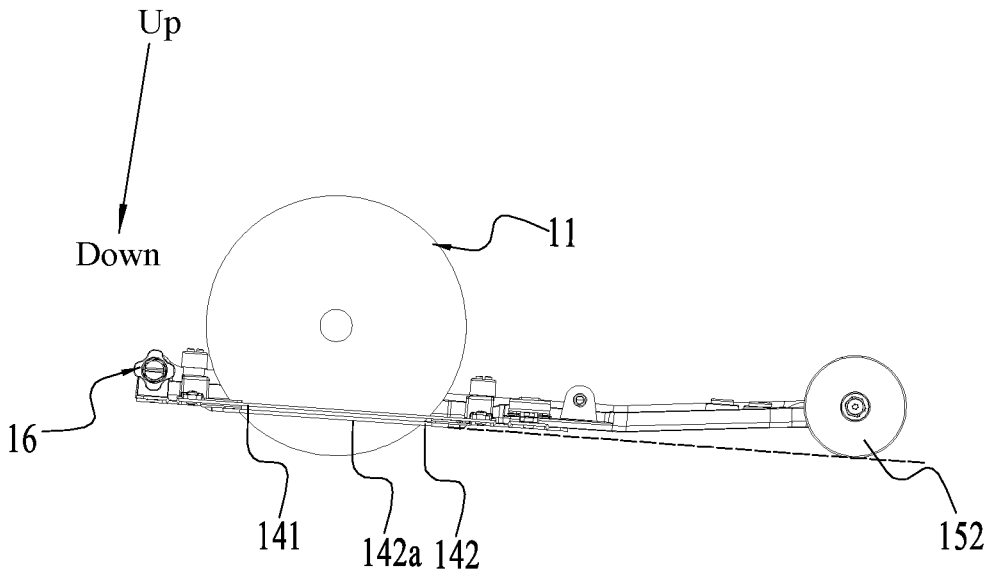
FIG. 2 is a plan view of a partial structure of the concrete cutting machine of FIG. 1.

FIG. 1 is a schematic view of a concrete cutting machine 100 according to a first example. As shown in FIGS. 1 to 4, the concrete cutting machine 100 includes a saw blade 11, a motor 12, a bottom plate 13, a sliding plate assembly 14, and a push rod 18. The saw blade 11 is configured to cut concrete, and the motor 12 is configured to drive the saw blade 11 to rotate about a first axis 101. In an implementation, a transmission assembly is also disposed between the motor 12 and the saw blade 11. The bottom plate 13 is configured to mount the motor 12, the transmission assembly and the saw blade 11. The bottom plate 13 is formed with a first cutting space 131 for the saw blade 11 to pass through, and the first cutting space 131 may be a circumferentially closed slot, or may be a partially or completely open space. In this example, the first cutting space 131 is a notch formed by the depression on the bottom plate 13. Generally speaking, after the saw blade 11 is mounted to the transmission assembly or the motor 12, the saw blade 11 is at least partially located in the first cutting space 131 and is fixed relative to the bottom plate 13 in a direction perpendicular to the saw blade 11. The push rod 18 is connected to the bottom plate 13 and is operable by an operator to control the operation of the concrete cutting machine 100.

The concrete cutting machine 100 further includes the sliding plate assembly 14, the sliding plate assembly 14 is detachably connected to the bottom plate 13, at least part of the sliding plate assembly 14 is disposed in the first cutting space 131 to form a second cutting space 131' which is smaller than the first cutting space 131 and for the saw blade 11 to pass through. That is to say, when the concrete cutting machine 100 cuts the full-dry concrete, the saw blade 11 is disposed in the first cutting space 131 formed by the bottom plate 13; when the concrete cutting machine 100 cuts the green concrete, the sliding plate assembly 14 is disposed in the first cutting space 131, and the saw blade 11 is disposed in the second cutting space 131'. When the green concrete is cut, a cutting seam is easy to deform, such as collapse, burrs, unevenness and the like, and when the saw blade 11 performs cutting, the sliding plate assembly 14 can flatten the concrete to be cut to keep the concrete surface and the cutting seam of the concrete flat to prevent deformation. That is to say, the concrete cutting machine 100 without the sliding plate assembly 14 mounted can be used to cut full-dry concrete, and the concrete cutting machine 100 with the sliding plate assembly 14 mounted can be used to cut green concrete. Preferably, the saw blades 11 with different cutting strength can be selected under the above two working conditions.

The sliding plate assembly 14 is movable relative to the saw blade 11 in a direction parallel to the first axis 101. In fact, a position of the saw blade 11 relative to the bottom plate 13 is substantially fixed, which can be understood as that the sliding plate assembly 14 moves within a preset range relative to the bottom plate 13 in a direction parallel to the first axis 101. In this way, a position of the sliding plate assembly 14 is adjustable in the direction parallel to the first axis 101, the sliding plate assembly 14 can be more easily and accurately mounted to the bottom plate 13, and the saw blade 11 is enabled to pass through the second cutting space 131' without interference with the sliding plate assembly 14.

As shown in FIGS. 2, and 4 to 6, the sliding plate assembly 14 includes a supporting member 141 and a flattening member 142. The supporting member 141 is connected to the bottom plate 13 and movable relative to the bottom plate 13 in the direction parallel to the first axis 101; the flattening member 142 has a flattening surface 142*a* parallel to the first axis 101, and in a second direction perpendicular to the flattening surface 142*a*, the flattening surface 142*a* is located below the supporting member 141, and the flattening surface 142*a* is specifically a lower end surface of the flattening member 142. The flattening surface 142*a* is configured for being in contact with the surface of the green concrete and applying a certain pressure to the concrete surface to flatten the surface. In this example, the flattening surface 142*a* is substantially a rectangular surface slotted in the middle. The supporting member 141 can move back and forth relative to the bottom plate 13 in the direction parallel to the first axis 101.

The concrete cutting machine 100 further includes a front wheel 151 and a rear wheel 152 which are disposed in front of and behind the sliding plate assembly 14 along an advancing direction of the concrete cutting machine 100, respectively. The rear wheel 152 is mounted to a rear wheel shaft, and the rear wheel shaft is mounted to the bottom plate 13. Preferably, a shaft sleeve is mounted in a direction parallel to the wheel shaft, so that the rear wheel 152 is farther away from a cutting line to avoid the rear wheel 152 from pressing against the cutting line. A lowest point of the rear wheel 152 in the second direction perpendicular to the flattening surface 142*a* is located in a plane where the flattening surface 142*a* is located.

The concrete cutting machine 100 further includes a mounting assembly 16 for mounting the sliding plate assembly 14 to the bottom plate 13, and the mounting assembly 16 is movably connected to the sliding plate assembly 14. In this example, the mounting assembly 16 includes a rotation operating member 161 which is rotatably connected to the bottom plate 13 and the sliding plate assembly 14 separately; when the rotation operating member 161 rotates about a second axis 102 relative to the bottom plate 13, a sliding plate assembly 14 moves relative to the bottom plate 13 in a direction of the second axis 102. The second axis 102 is parallel to the first axis 101.

Specifically, the mounting assembly 16 includes a mounting shaft 162, a connecting member 163, a locking member 164, and the rotation operating member 161 which connect the sliding plate assembly 14 and the bottom plate 13. The bottom plate 13 is provided with a hole for the mounting shaft 162 to pass through, the mounting shaft 162 is rotatably connected to the bottom plate 13 for, and one end of the locking member 164 is inserted into the mounting shaft 162. A surface of the locking member 164 is sleeved with the rotation operating member 161, a surface of the rotation operating member 161 is sleeved with the connecting member 163 and is threaded connected to the connecting member 163. The threaded connection here is also regarded as the rotation connection. One end of the connecting member 163 is rotatably connected to the rotation operating member 161, and the other end of the connecting member 163 is fixedly connected to the sliding plate assembly 14 in a direction parallel to the second axis 102. That is, the rotation operating member 161 is disposed between the locking member 164 and the connecting member 163 in a radial direction. In the direction of the second axis 102, an end surface of one end of the rotation operating member 161 abuts against an end surface of the mounting shaft 162, and the other end of the rotation operating member 161 is provided with a rotation operating portion 161*a* for the user to rotate. When the user needs to adjust the position of the sliding plate assembly 14 in the direction of the second axis 102, the rotation operating member 161 merely needs to be tightly abutted against the mounting shaft 162 in an axial direction and operated in a circumferential direction at the same time. Due to the threaded connection between the connecting member 163 and the rotation operating member 161, when the rotation operating member 161 rotates about the second axis 102 in a first direction, the connecting member 163 moves leftwards relative to the rotation operating member 161 in the direction of the second axis 102. Due to the fact that the connecting member 163 is fixedly connected with the sliding plate assembly 14 in the direction parallel to the second axis 102, the sliding plate assembly 14 moves leftwards along with the connecting member 163 relative to the rotation operating member 161 in the direction of the second axis 102; when the rotation operating member 161 rotates about the second axis 102 in a second direction opposite to the first direction, the connecting member 163 moves rightwards relative to the rotation operating member 161 in the direction of the second axis 102, and then the sliding plate assembly 14 moves rightwards along with the connecting member 163 relative to the rotation operating member 161 in the direction of the second axis 102. In order to reduce a load when the user operates the rotation operating member 161, a certain gap exists between the locking member 164 and the rotation operating member 161 in the axial direction, and an elastic sheet 164' is disposed in the gap.

Specifically, the connecting member 163 is connected to the sliding plate assembly 14 through a connection structure such as screws, so that the connecting member 163 is fixedly connected to the sliding plate assembly 14 in the direction parallel to the second axis 102. The connecting member 163 is rotatable relative to the sliding plate assembly 14 about an axis perpendicular to the flattening surface 142*a*, so that the mounting assembly 16 can be finely adjusted in a circumferential direction of the axis perpendicular to the flattening surface 142*a* when the sliding plate assembly 14 is mounted.

It should be noted that the locking member 164 may be a screw, a rivet, a stud, a screw rod or a bolt, etc. When threads are provided on the surface of the locking member 164, the locking member 164 is threaded connected to the rotation operating member 161; when no threads is provided on the surface of the locking member 164, the locking member 164 is rotatably connected to the rotation operating member 161. In addition, the specific structure of the mounting assembly 16 is not limited to the implementation in this example, and the mounting assembly may be one component or a plurality of components working together to achieve the function of mounting the sliding plate assembly to the bottom plate. For example, the mounting assembly 16 may be slidably connected to the sliding plate assembly 14, or the mounting assembly 16 is provided with a plurality of switchable connecting portions connected to the sliding plate assembly 14, the user can perform manual adjustment according to the actual working conditions, and other examples that are extended by those skilled in the art based on the technical solutions disclosed should fall within the protection scope of the appended claims.

The mounting assembly 16 further includes a fastening member 165 for connecting the bottom plate 13 and the sliding plate assembly 14, and the fastening member 165 has a locked and unlocked state which are switchable; when the fastening member 165 is in the locked state, the bottom plate 13 is fixedly connected to the sliding plate assembly 14, and when the fastening member 165 is the unlocked state, the bottom plate 13 is movably connected to the sliding plate assembly 14; positions of the rotation operating member 161 and the fastening member 165 with respect to the saw blade 11 are on two ends of the sliding plate assembly 14 respectively. In this example, the mounting shaft 162, the connecting member 163, the locking member 164, and rotation operating member 161 are disposed on one end of the sliding plate assembly 14 along a length direction of the sliding plate assembly 14, and the fastening member 165 is disposed on the other end of the sliding plate assembly 14. In an example, the fastening member 165 is a quick clip for connecting the supporting member 141 and the bottom plate 13 so that the supporting member 141 is fixedly connected or movably connected to the bottom plate 13. When the position of the sliding plate assembly 14 relative to the bottom plate 13 does not need to be adjusted, the quick clip is in the locked state; when the position of the sliding plate assembly 14 relative to the bottom plate 13 needs to be adjusted, the quick clip is switched to be in the unlocked state, then the rotation operating member 161 is adjusted, and at this time, the entire sliding plate assembly 14 moves leftwards or rightwards relative to the bottom plate 13 in the direction of the second axis 102. It should be understood that the fastening member 165 may also be screws or other fastening members 165 that can adjust the locked state. For example, in the first direction parallel to the first axis 101 and/or in the second direction perpendicular to the flattening surface 142*a*, screws are used to fix the supporting member 141 and the bottom plate 13.

In an optional example, the fastening member 165 may also be movably connected to the bottom plate 13 and the sliding plate assembly 14 in a direction perpendicular to the saw blade 11. For example, a bolt or a pin is used to connect the bottom plate 13 and the supporting member 141, and a hole formed between the supporting member 141 and the bottom plate 13 for mounting the pin or the bolt is a long hole, such as a waist hole, so that the supporting member 141 is fixedly connected to the bottom plate 13 in the direction parallel to the saw blade 11 and is movable in the direction perpendicular to the saw blade 11.

Figure 3:
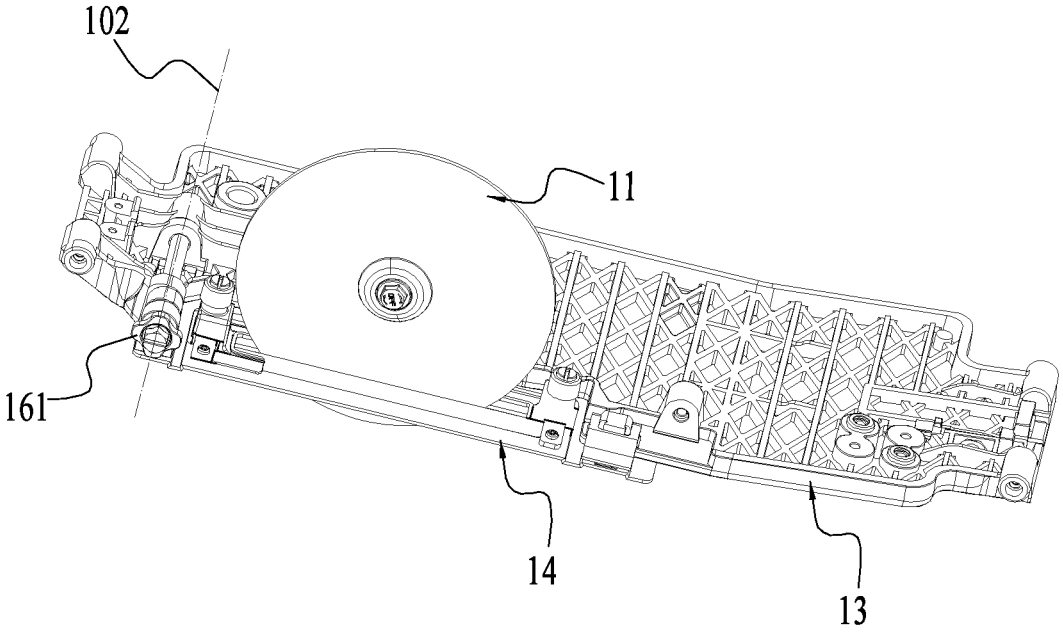
FIG. 3 is a perspective view of a partial structure of the concrete cutting machine of FIG. 1.
Figure 4:
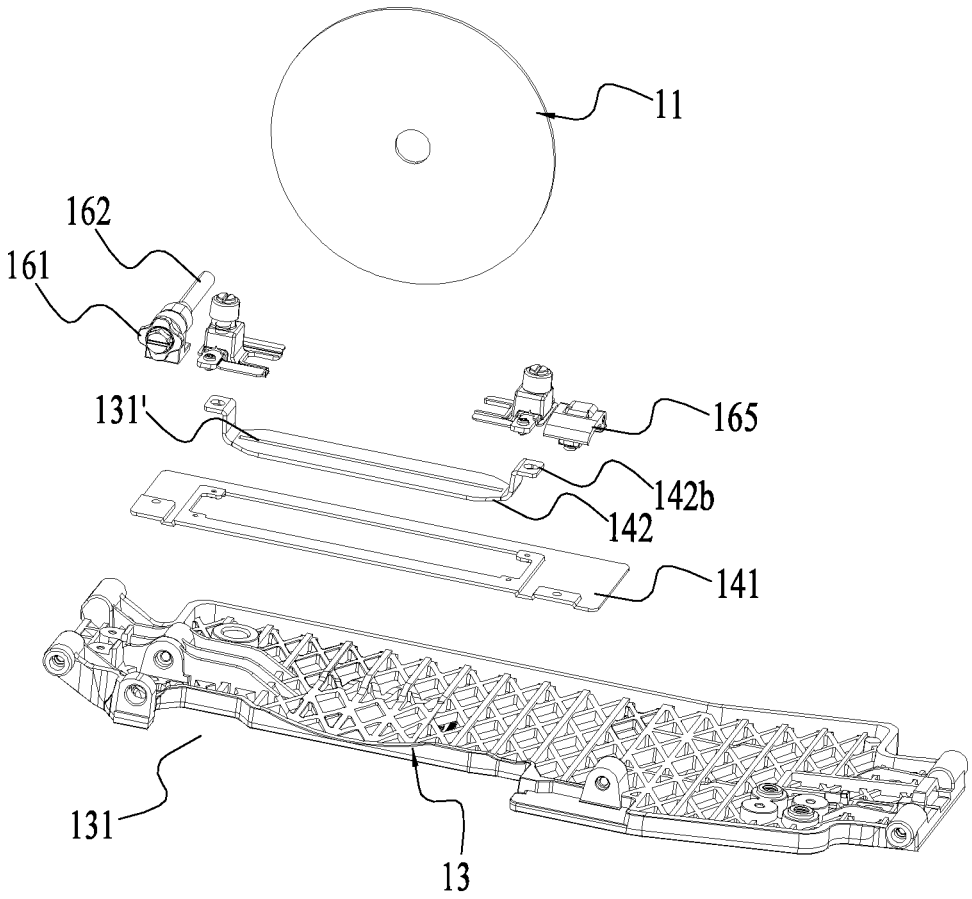
FIG. 4 is an exploded view of a partial structure of the concrete cutting machine of FIG. 1.
Figure 5:
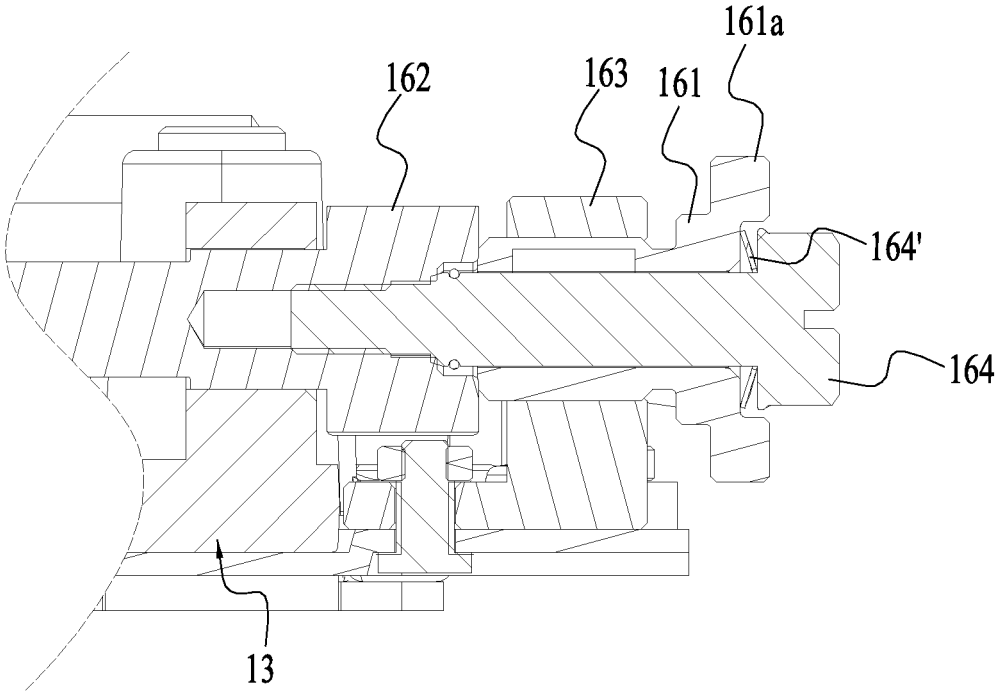
FIG. 5 is a cross-sectional view of a partial structure of the concrete cutting machine of FIG. 1.
Figure 6:
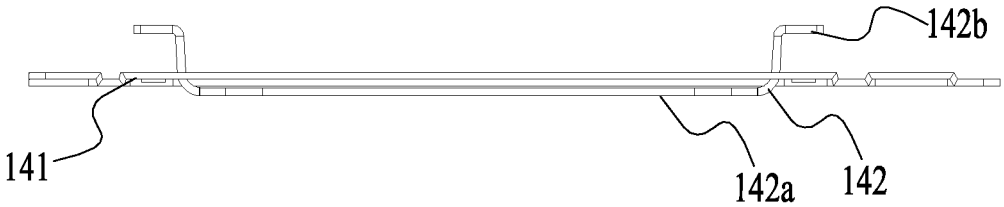
FIG. 6 is a plan view of a supporting member and a flattening member of the concrete cutting machine of FIG. 1.
Figure 7:
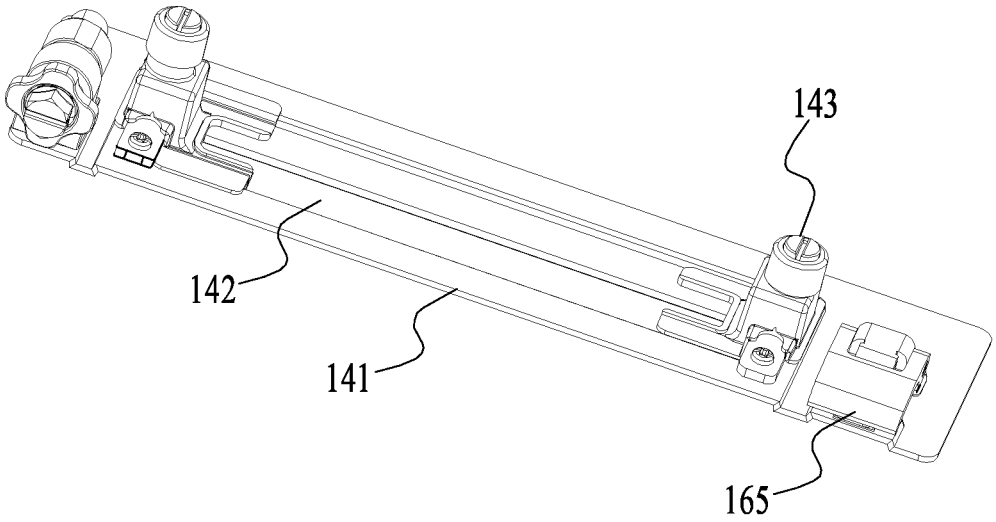
FIG. 7 is a perspective view of a partial structure of the concrete cutting machine of FIG. 1.
Figure 8:
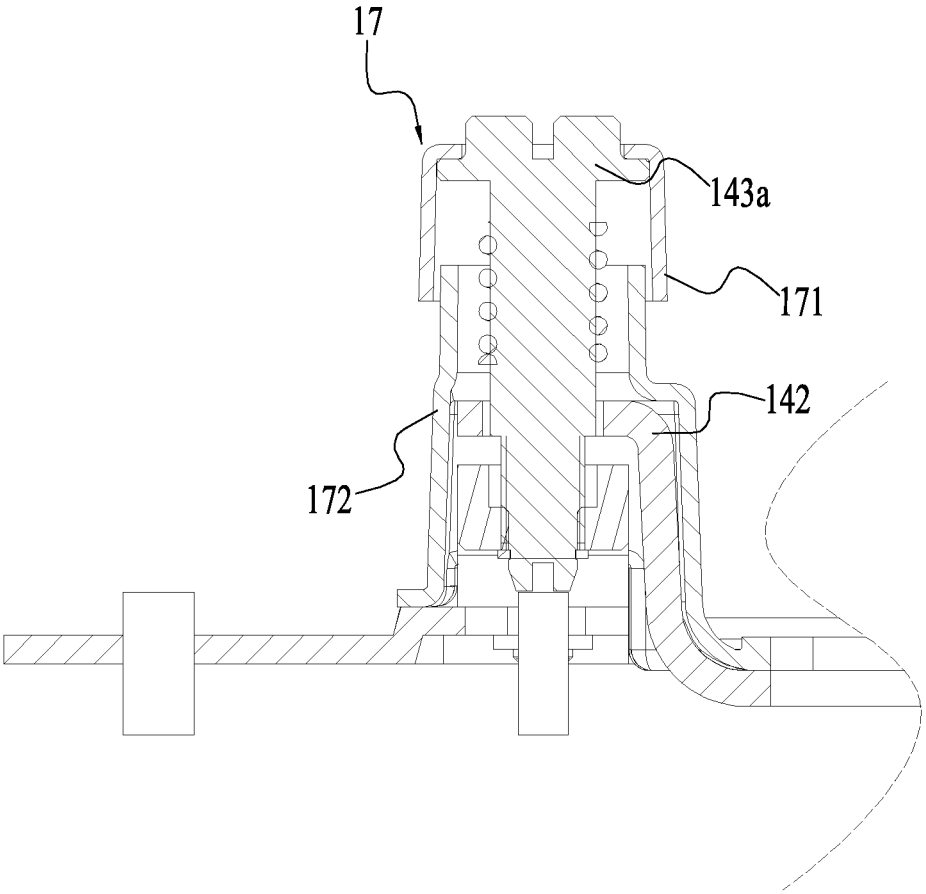
FIG. 8 is a cross-sectional view of a partial structure of the concrete cutting machine of FIG. 1.
Figure 9:
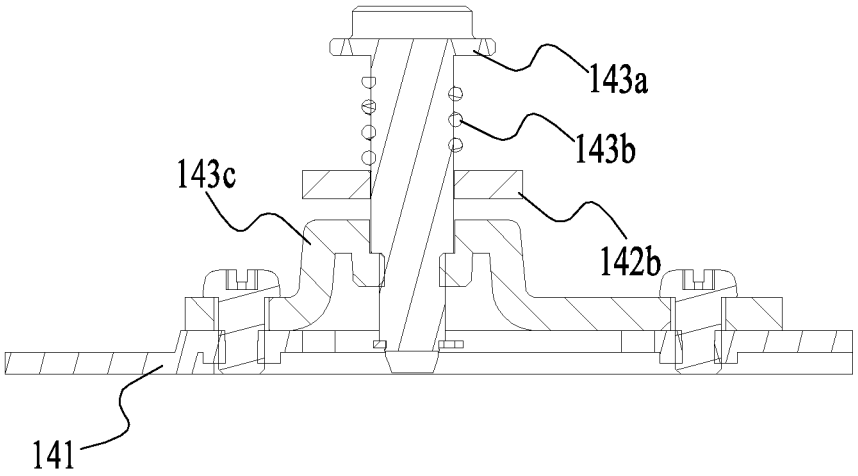
FIG. 9 is a cross-sectional view of a partial structure of the concrete cutting machine of FIG. 1.

As shown in FIGS. 4, and 7 to 9, the sliding plate assembly 14 (as shown in FIG. 3) can be mounted to the bottom plate 13 as a whole. That is to say, the sliding plate assembly 14 has been assembled as a whole before being mounted to the bottom plate 13. Specifically, the sliding plate assembly 14 includes a connecting assembly 143 connecting the supporting member 141 and the flattening member 142, the connecting assembly 143 connects the supporting member 141 and the flattening member 142 as a whole, and then the sliding plate assembly 14 is mounted to the bottom plate 13 in the direction parallel to the first axis 101 through the mounting assembly 16, which facilitates the disassembly and assembly when the user switches between wet and dry cutting functions. The supporting member 141 is fixedly connected or movably connected to the flattening member 142 in the second direction perpendicular to the flattening surface 142*a*. In this example, the supporting member 141 is elastically connected to the flattening member 142. Specifically, the connecting assembly 143 includes a biasing member 143*b* that is elastically deformable in the second direction perpendicular to the flattening surface 142*a*, and one end of the biasing member 143*b* abuts against the flattening member 142.

In this example, in the second direction perpendicular to the flattening surface 142*a*, the flattening member 142 and the supporting member 141 are connected through a movable connecting member such as a screw or a bolt that can move up and down relative to the supporting member 141. Specifically, a shoulder screw 143*a* is used to connect one end of the flattening member 142 and one end of the supporting member 141. In the second direction perpendicular to the flattening surface 142*a*, the flattening member 142 is disposed above the supporting member 141, the biasing member 143*b* is mounted between the flattening member 142 and a nut, the biasing member 143*b* is always in a compressed state, and one end of the biasing member 143*b* abuts against the flattening member 142 to apply a biasing force to the flattening member 142, so that a certain pressure is applied to the concrete surface when the flattening surface 142*a* is in contact with the concrete surface. The user can adjust the biasing force of the biasing member 143*b* applied to the flattening member 142 by adjusting the screw-in length of the screw according to the specific working condition and concrete state. The biasing member 143*b* is specifically a compression spring. In the second direction perpendicular to the flattening surface 142*a*, a limiting member 143*c* is further disposed between the flattening member 142 and the supporting member 141 to limit displacements of the flattening member 142 and the biasing member 143*b*. The limiting member 143*c* is fixedly connected to the supporting member 141.

The flattening member 142 includes a mounting portion 142*b* connected to the supporting member 141, and the mounting portion 142*b* is located above the supporting member 141 in the second direction perpendicular to the flattening surface 142*a*. The mounting portion 142*b* may be directly connected to the supporting member 141 or indirectly connected to the supporting member 141. In this example, the flattening member 142 and the supporting member 141 are indirectly connected by a screw. In fact, the biasing member 143*b* is disposed between the mounting portion 142*b* and the nut. That is to say, both the mounting portion 142*b* and the biasing member 143*b* are disposed above the supporting member 141 in the second direction perpendicular to the flattening surface 142*a*. A height of the sliding plate assembly 14 and a height of the concrete cutting machine 100 are smaller in the longitudinal direction through this design, so that the structure is more compact.

The concrete cutting machine 100 further includes a dust-proof assembly 17 for preventing dust from entering two ends of the flattening member 142. In this example, the dust-proof assembly 17 is mounted to the connecting assembly and wraps or covers at least part of the flattening member 142. The dust-proof assembly 17 includes a first dust-proof portion 171 and a second dust-proof portion 172, the first dust-proof portion 171 is mounted to the nut of the shoulder screw 143*a* connecting the supporting member 141 and the flattening member 142, and the second dust-proof portion 172 is mounted to the flattening member 142. The first dust-proof portion 171 is movable when the shoulder screw 143*a* moves up and down, and the second dust-proof portion is movable when the flattening member 142 moves up and down. The dust-proof assembly 17 surrounds and forms a space wrapping the connecting assembly in the circumferential direction, thereby preventing the entry of dust.

Figure 10:
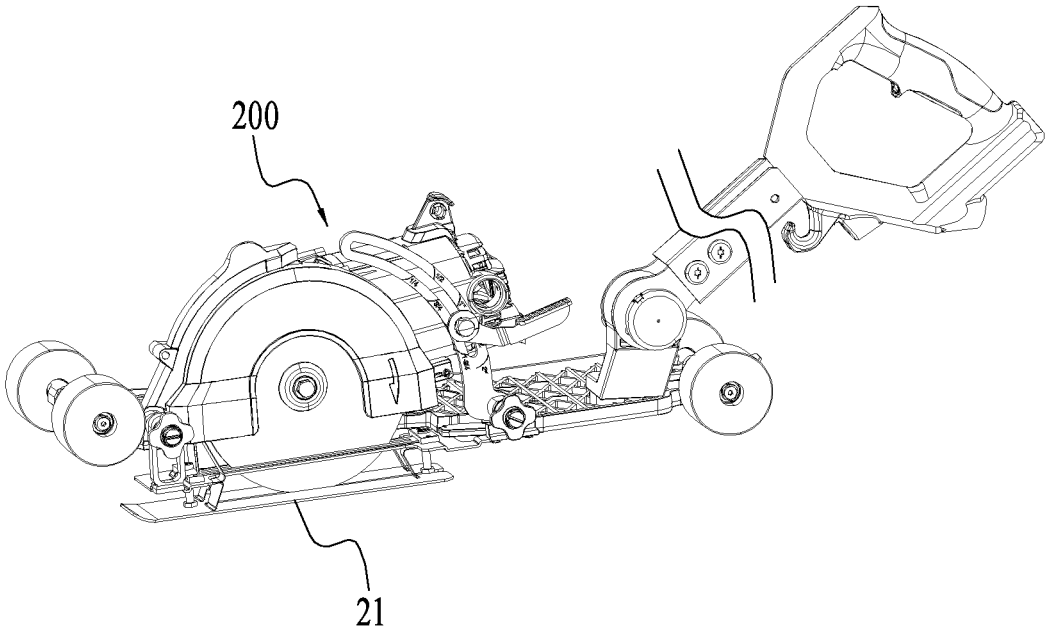
FIG. 10 is a perspective view when a sliding plate assembly of a concrete cutting machine is in a first position according to a second example.

FIG. 10 shows a schematic view of a concrete cutting machine 200 with a sliding plate assembly 21 mounted according to a second example. This example has substantially the same saw blade, motor, bottom plate, push rod, etc. as the first example, and differs from the first example merely in the mounting manner and specific structure of the sliding plate assembly 21. The parts of the first example that are compatible with this example can be applied to this example. Merely the part of this example that is different from the first example is introduced below.

Figure 11:
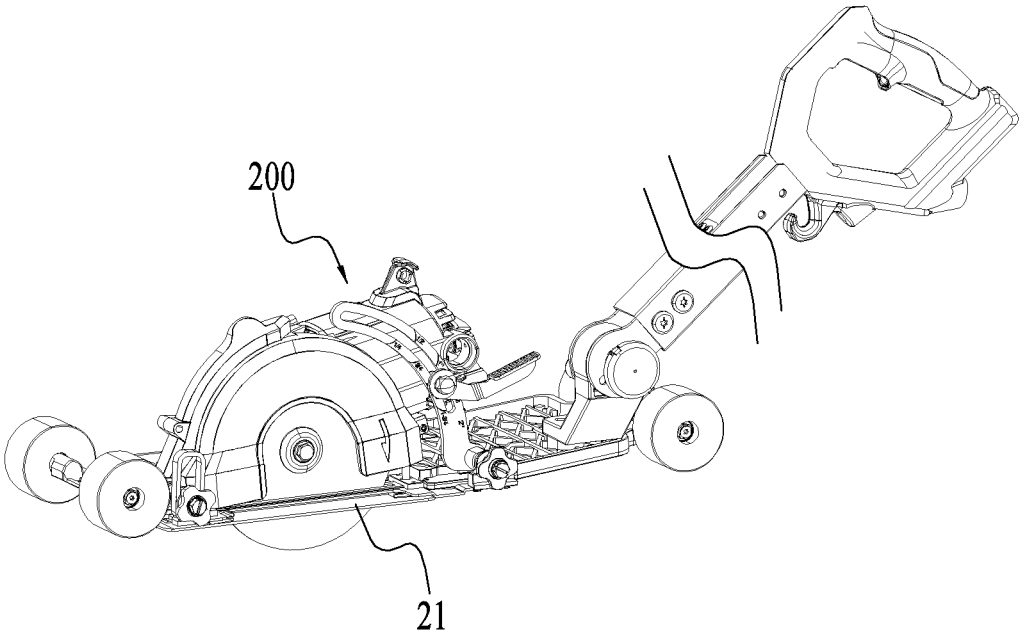
FIG. 11 is a perspective view when the sliding plate assembly of the concrete cutting machine of FIG. 10 is in a second position.

As shown in FIGS. 10 to 11, in this example, the sliding plate assembly 21 includes a first position away from the bottom plate and a second position adjacent to the bottom plate. When the operator operates the concrete cutting machine 200 to cut green concrete, the push rod is first lightly pressed, so that the entire concrete cutting machine 200 is raised with the rear wheel as a fulcrum, the sliding plate assembly 21 is located at the first position away from a lower side of the bottom plate and squeezes the green concrete in advance before the saw blade is in contact with the concrete, and as a cutting depth of the saw blade relative to the concrete increases, the sliding plate assembly 21 always keeps squeezing the concrete until the saw blade achieves a maximum cutting depth, and the sliding plate assembly 21 moves to a second position. A better cutting surface is obtained, and the phenomena of collapse and unevenness of the concrete cutting gap are avoided.

Specifically, the sliding plate assembly 21 includes a supporting member 211 and a flattening member 212, and further includes an elastic assembly disposed between the supporting member 211 and the flattening member 212. The elastic assembly may be specifically a first elastic member 213 and a second elastic member 214. Specifically, the supporting member 211 is disposed between the flattening member 212 and the bottom plate, and the supporting member 211 is configured for connecting the flattening member 212 to form the entire sliding plate assembly 21. The first elastic member 213 is disposed on a rear side of the sliding plate assembly 21, and the second elastic member 214 is disposed on a front side of the sliding plate assembly 21. An elastic force of the first elastic member 213 is greater than an elastic force of the second elastic member 214. In an implementation, both the first elastic member 213 and the second elastic member 214 are made of elastic sheets. In order to make the elastic force of the first elastic member 213 greater than the elastic force of the second elastic member 214, a length of the elastic sheet of the first elastic member 213 can be set to be smaller than a length of the elastic sheet of the second elastic member 214; or a thickness of the elastic sheet of the first elastic member 213 can be set to be greater than a thickness of the elastic sheet of the second elastic member 214. In fact, it suffices to achieve that the elastic force of the first elastic member 213 is greater than the elastic force of the second elastic member 214, which will not be repeated here.

Figure 12:
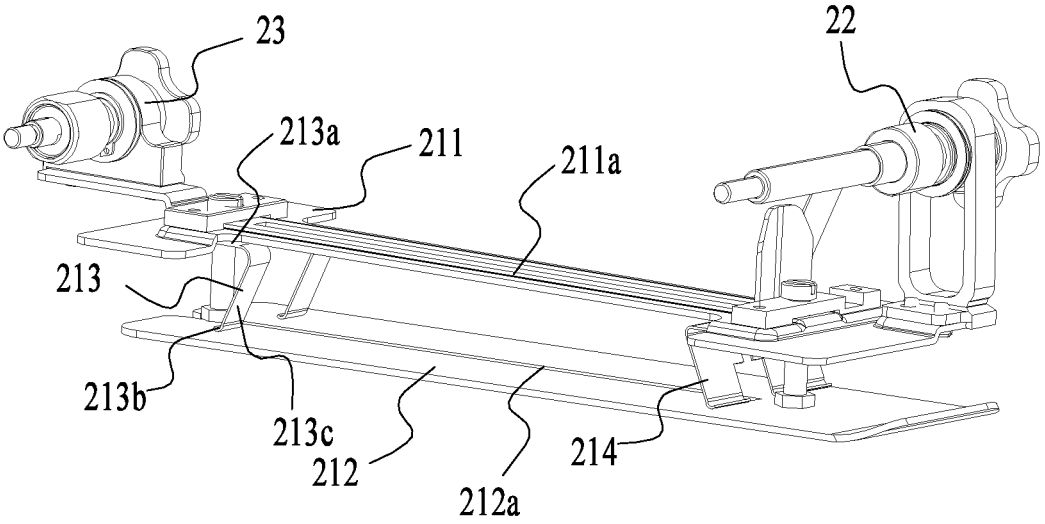
FIG. 12 is a perspective view of the sliding plate assembly of the concrete cutting machine of FIG. 10.
Figure 13:
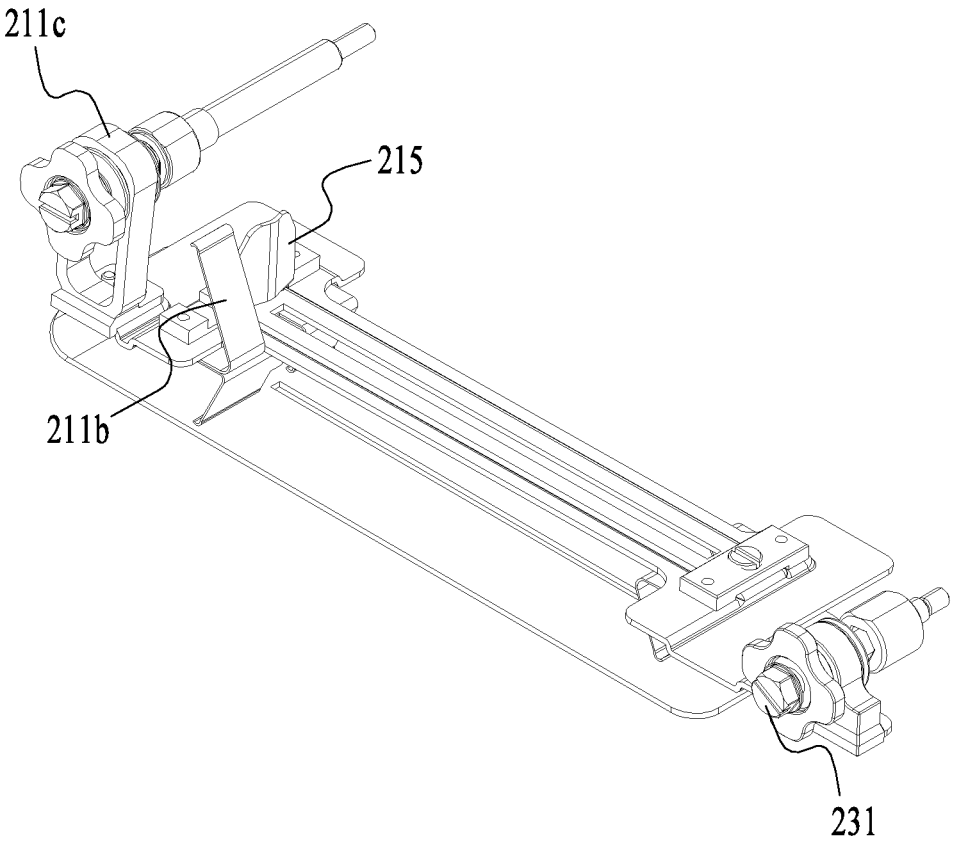
FIG. 13 is another perspective view of the sliding plate assembly of the concrete cutting machine of FIG. 12.

As shown in FIGS. 12 to 13, the first elastic member 213 and the second elastic member 214 are disposed between the supporting member 211 and the flattening member 212 and each connect the supporting member 211 and the flattening member 212. In an implementation, the support member 211 and the flatting member 212 each are provided with an opening for the saw blade to pass through. A first opening 211*a* is disposed on the supporting member 211 for the saw blade to pass through, and a second opening 212*a* is disposed on the flattening member 212 for the saw blade to pass through, where a width of the first opening 211*a* in the direction of the first axis is greater than or equal to a width of the second opening 212*a* in the direction of the first axis. It should be understood that when the sliding plate assembly 21 is mounted to the bottom plate, the saw blade first passes through the first opening 211*a*, and then passes through the second opening 212*a*. The saw blade here is allowed to pass through in a position almost parallel to the second opening 212*a*; the second opening 212*a* can effectively flatten the cutting seam, and makes the periphery of the cutting seam smoother. In an implementation, the first elastic member 213 and the second elastic member 214 each can adopt a form of two elastic sheets arranged in parallel, so that the connection between the supporting member 211 and the flattening member 212 is relatively stable, making the sliding plate assembly 21 evenly stressed. In fact, the first elastic member 213 and the second elastic member 214 each may be formed by one elastic sheet and formed with an opening through which the saw blade can pass. The first elastic member 213 is taken as an example here, and the first elastic member 213 includes a first end 213*a* and a second end 213*b*. The first end 213*a* is connected to the supporting member 211, and the second end 213*b* is connected to the flattening member 212. An elastic portion is disposed between the first end 213*a* and the second end 213*b*, and the elastic portion has a certain elastic force, and is elastically deformable when compressed and can store a certain elastic force. Specifically, the first end 213*a* and the second end 213*b* are located on the same side relative to the elastic portion. When the first elastic member 213 and the second elastic member 214 are mounted between the supporting member 211 and the flattening member 212, the first elastic member 213 and the second elastic member 214 are configured to have a certain pre-tightening force, so that the sliding plate assembly 21 can have a certain damping effect during compression, and deformation of the concrete cut due to instantaneous deformation is avoided. In another implementation, the first elastic member 213 and the second elastic member 214 each may be configured to adopt a torsion spring structure. Specifically, one end of the torsion spring is connected to the supporting member 211 and the other end of the torsion spring is connected to the flattening member 212. In fact, the supporting member 211 and the flattening member 212 can be provided with any elastic component that has the elastic force and can cause a damping effect between the supporting member 211 and the flattening member 212, which will not be repeated here.

In an implementation, a third elastic member 211*b* is also disposed on the supporting member 211. The third elastic member 211*b* abuts a shield. In an implementation, the third elastic member 211*b* may be configured as an elastic sheet or a torsion spring. A connecting shaft for sleeving a torsion spring may be formed on the supporting member 211, one end of a torsion spring abuts the supporting member, and the other end abuts the shield, so that the sliding plate assembly 21 can reset to the first position. A rail portion 211*c* is also formed or connected to the supporting member 211. The sliding plate assembly 21 is connected to the concrete cutting machine 200 through a first mounting assembly 22 and a second mounting assembly 23. The first mounting assembly 22 is configured for adjusting the position of the sliding plate assembly 21 along a first direction parallel to the first axis, so that the first opening 211*a* and the second opening 212*a* can be effectively aligned with the saw blade. The operating principle is substantially the same as the operating principle in the first example, and will not be repeated here. In addition, the first mounting assembly 22 can also adjust the sliding plate assembly 21 to rotate between the first position and the second position. The second mounting assembly 23 is configured for rotatably connecting the sliding plate assembly 21 to the bottom plate and includes a pivot shaft 231 that enables the sliding plate assembly 21 to rotate about the second mounting assembly 23. The first mounting assembly 22 passes through the rail portion 211*c* and is mounted on the concrete cutting machine 200, and can freely move in the up-down direction around the pivot shaft 231 in the rail portion 211*c*. When the operator operates the concrete cutting machine 200 to cut green concrete, the push rod is lightly pressed first, then the concrete cutting machine 200 is raised with the rear wheel as a fulcrum, and the push rod is slowly released. At this time, the flattening member 212 first abuts the green concrete. When the saw blade is in contact with the green concrete, the sliding plate assembly 21 starts to rotate around the pivot shaft 231 and rotates to the second position within a range of the rail portion 211*c*, and then the first elastic member 213 and the second elastic member 214 start to be compressed, enabling the sliding plate assembly 21 always to press against the green concrete. At the same time, the third elastic member 211*b* is also compressed until the first elastic member 213, the second elastic member 214, and the third elastic member 211*b* are compressed to the limit, and the saw blade achieves a maximum cutting depth. In this process, due to the combined effect of the first elastic member 213 and the second elastic member 214, the sliding plate assembly 21 always abuts against the green concrete. The rail portion 211*c* is provided and the sliding plate assembly 21 is configured to rotate within the range of the rail portion 211*c*, so that the saw blade is in a large range of cut depth, and the sliding plate assembly 21 always keeps in abutment with the green concrete.

In an implementation, the sliding plate assembly 21 further includes a dust-blocking structure. The dust-blocking structure may be specifically configured as a dust-blocking piece 215. When the saw blade rotates at a high speed to cut concrete, the dust-blocking piece 215 can effectively block debris or dust and change a splashing direction of debris or dust to prevent debris or dust from entering a space between the supporting member 211 and the flattening member 212.

Figure 14:
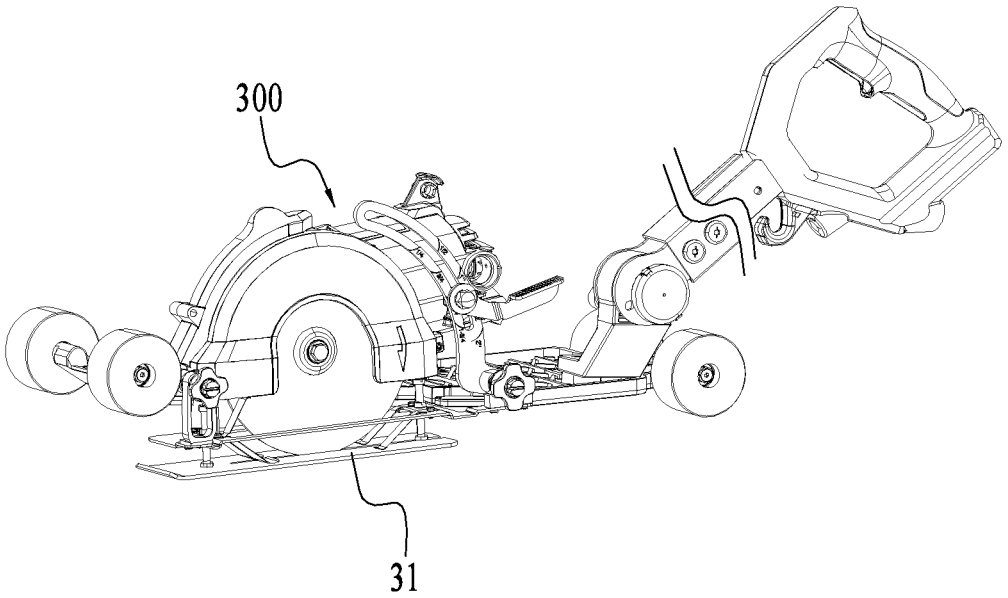
FIG. 14 is a perspective view when a sliding plate assembly of a concrete cutting machine is in a first position according to a third example.

FIG. 14 shows a schematic view of a concrete cutting machine 300 with a sliding plate assembly mounted according to a third example. This example has substantially the same saw blade, motor, bottom plate, push rod, etc. as the second example, and differs from the second example merely in the specific structure of the sliding plate assembly. The parts of the second example that are compatible with this example can be applied to this example. Merely the part of this example that is different from the second example is introduced below.

Figure 15:
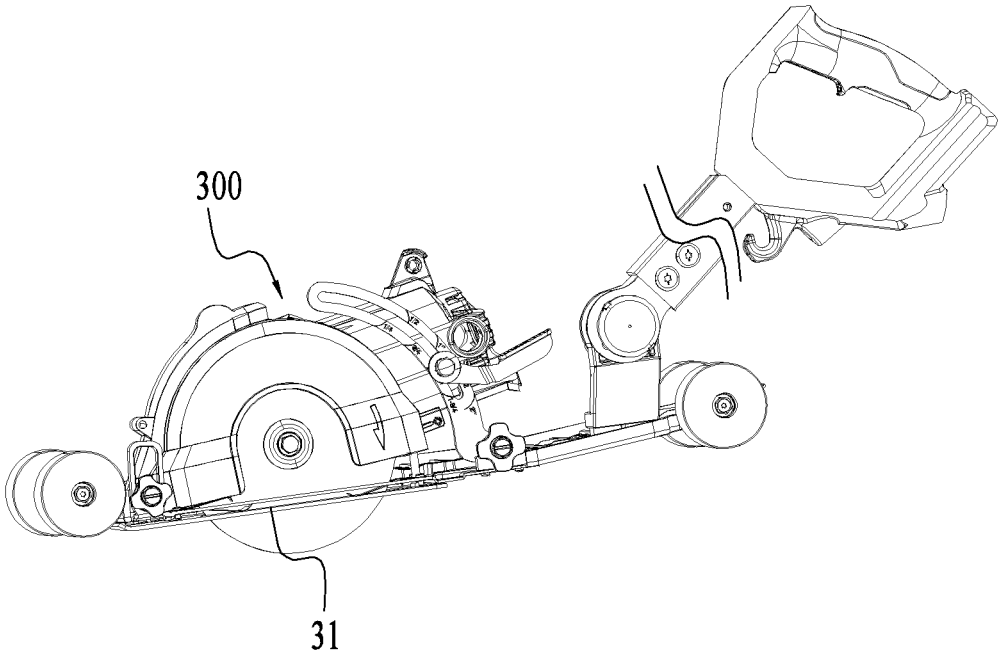
FIG. 15 is a perspective view when the sliding plate assembly of the concrete cutting machine of FIG. 14 is in a second position.
Figure 16:
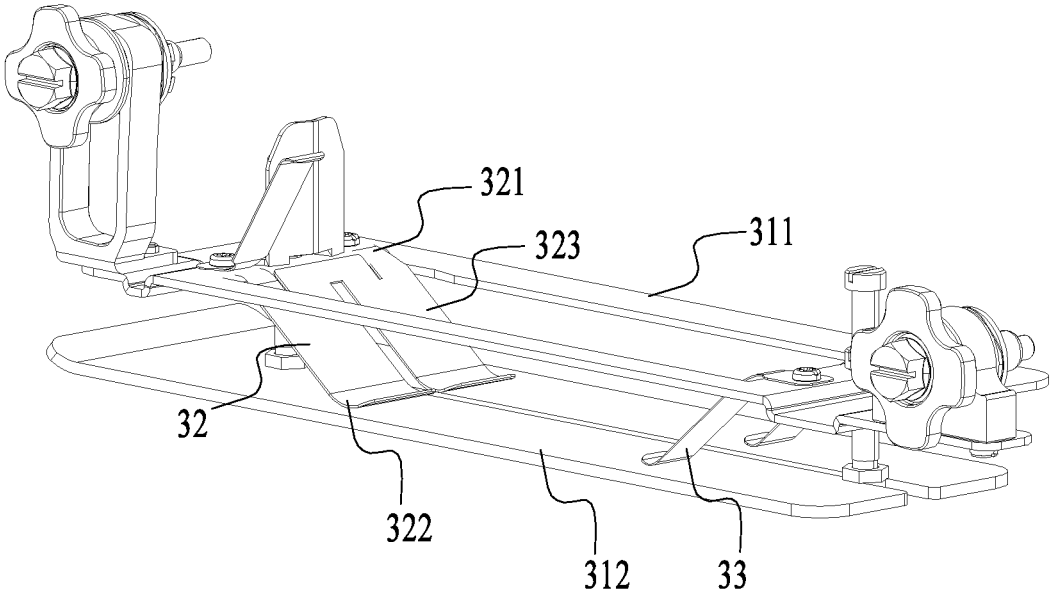
FIG. 16 is a perspective view of the sliding plate assembly of the concrete cutting machine of FIG. 14.
Figure 17:
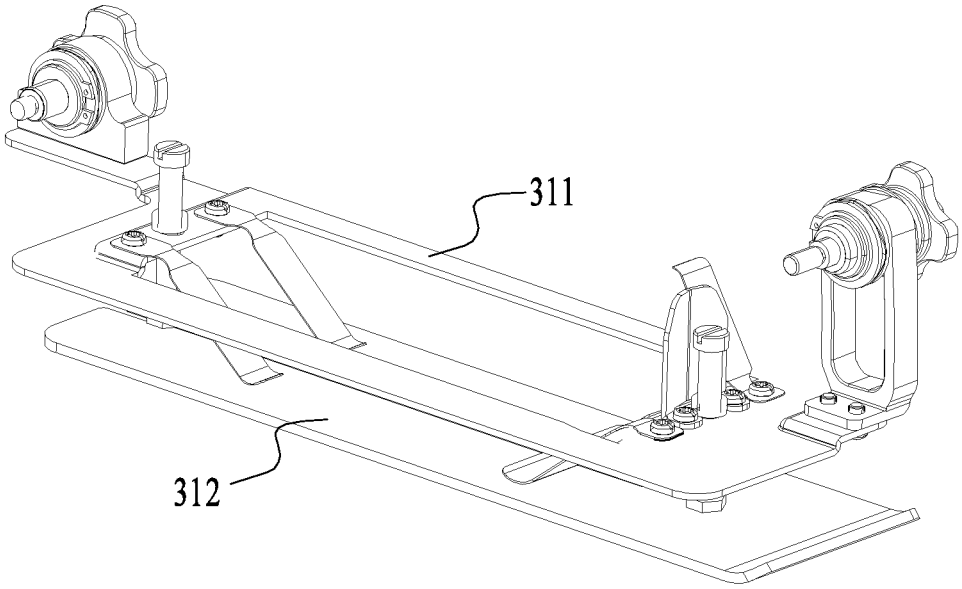
FIG. 17 is another perspective view of the sliding plate assembly of the concrete cutting machine of FIG. 16.

As shown in FIGS. 14 and 15, in this example, the sliding plate assembly 31 includes a first position away from the bottom plate and a second position adjacent to the bottom plate. As shown in FIGS. 16 and 17, a first elastic member 32 and a second elastic member 33 are disposed between a supporting member 311 and a flattening member 312 and each connect the supporting member 311 and the flattening member 312. A first end 321 and a second end 322 of the first elastic member 32 are located on two sides of the elastic portion 323.

Figure 18:
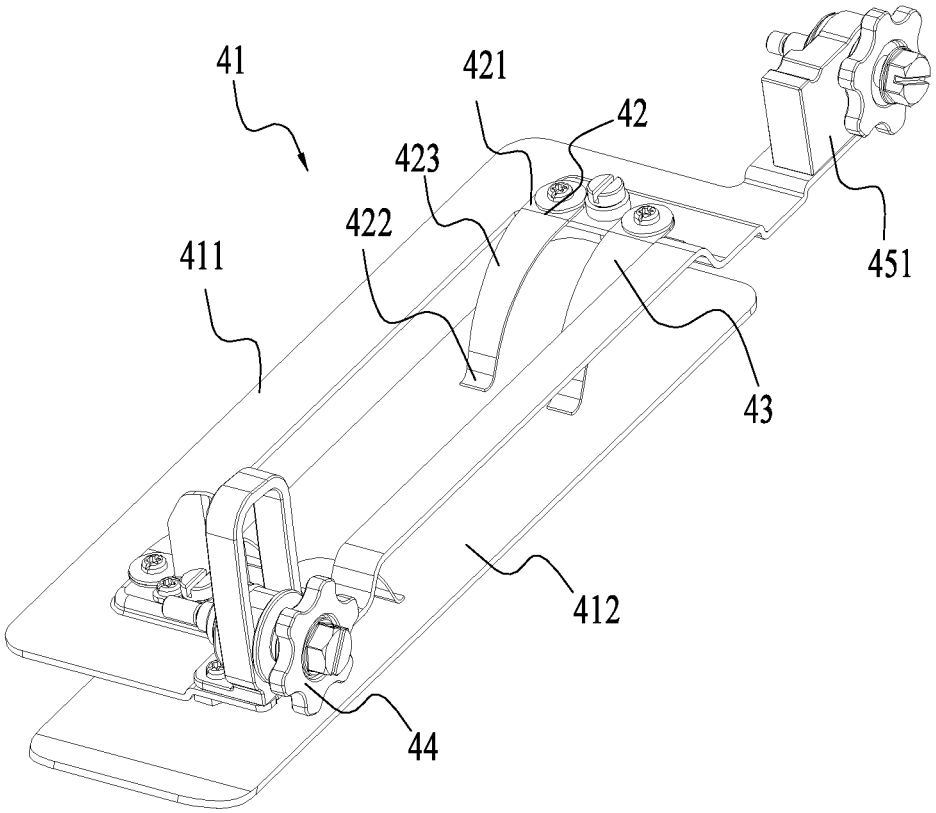
FIG. 18 is a perspective view of a sliding plate assembly of a concrete cutting machine according to a fourth example.

FIG. 18 shows a sliding plate assembly 41 of a concrete cutting machine 400 according to a fourth example, and the difference is merely that the structure of the sliding plate assembly 41 and the connection relationship between the concrete cutting machine 400 and the sliding plate assembly 41 are different. The parts of the second example that are compatible with this example can be applied to this example. Merely the part of this example that is different from the second example is introduced below.

In this example, the sliding plate assembly 41 includes a supporting member 411, a flattening member 412, and a first elastic member 42 and a second elastic member 43 which are disposed between the supporting member 411 and the flattening member 412. The first elastic members 42 are substantially of the same size. Two groups of first elastic member 42 and two groups of second elastic members 43 are provided. For the first elastic member 42, the first elastic member 42 includes a first end 421 and a second end 422. The first end 421 is connected to the supporting member 411, and the second end 422 abuts the flattening member 412. An elastic portion 423 is disposed between the first end 421 and the second end 422. The elastic portion 423 has a certain elastic force, is elastically deformable when compressed, and can store a certain elastic force. Specifically, in a first direction parallel to the first axis 401, a width of the first end 421 of the first elastic member 42 is greater than a width of the second end 422. More specifically, the first elastic member 42 is gradually narrowed from the first end 421 to the second end 422. Through this design, on the one hand, the problem of stress concentration is optimized, so that the strain resistance of the joint between the first end 421 of the first elastic member 42 and the supporting member 411 is enhanced, and the stress distribution can be effectively dispersed, so that the stress originally concentrated on the first end 421 is at least partially distributed to the elastic portion 423 or the second end 422. When the first elastic member 42 and the second elastic member 43 are mounted between the supporting member 411 and the flattening member 412, the first elastic member 42 and the second elastic member 43 are configured to have a certain pre-tightening force, so that the sliding plate assembly 41 can have a certain damping effect during compression, and deformation of the concrete cut due to instantaneous deformation is avoided.

Figure 19:
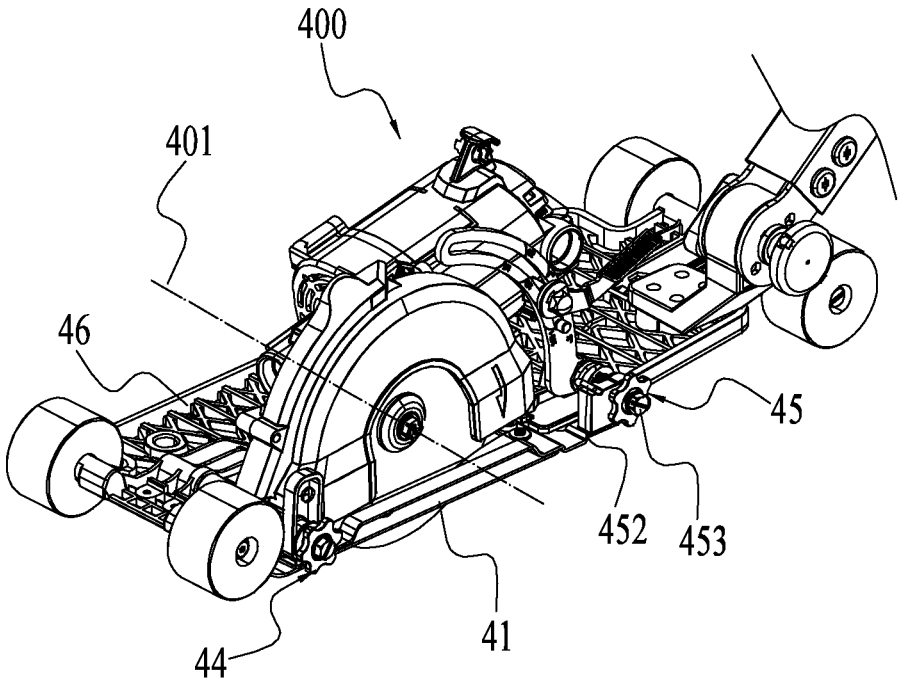
FIG. 19 is a perspective view of a concrete cutting machine according to a fourth example.

As shown in FIGS. 18-19, the sliding plate assembly 41 is connected to a bottom plate 46 through a first mounting assembly 44 and a second mounting assembly 45. The second mounting assembly 45 includes a pivot shaft 453 and a torsion spring 452. In an implementation, a mounting member 451 is also disposed on the sliding plate assembly 41, and the mounting member 451 is formed with a through hole for the pivot shaft 453 to pass through. The torsion spring 452 is disposed on the pivot shaft 453, one end of the torsion spring 452 abuts the bottom plate 46, the other end of the torsion spring abuts the mounting member 451, and a pre-tightening force is provided, so that the sliding plate assembly 41 always has a trend away from the bottom plate 46, and can return to the second position. When the concrete cutting machine 400 performs the cutting operation, the first elastic member 42 and the second elastic member 43 function together to make the sliding plate assembly 41 have a good pre-tightening force to keep at the state of the second position to improve the cutting quality of the concrete cutting machine 400.

The basic principles, main features and advantages of the examples have been shown and described above. Those skilled in the art should understand that the above examples do not limit the present invention in any form, and that any technical solution obtained by means of equivalent substitution or equivalent transformation falls within the protection scope of the appended claims.

What is claimed is:

1. A concrete cutting machine, comprising:

a saw blade configured to cut concrete;

a motor configured to drive the saw blade to rotate about a first axis;

a bottom plate configured to support the motor and the saw blade, wherein the bottom plate is recessed along the first axis to form a first cutting space for the saw blade to pass through; and a sliding plate assembly, which is at least partially disposed in the first cutting space to form a second cutting space smaller than the first cutting space, wherein the sliding plate assembly is detachably mounted to the bottom plate and is movable relative to the bottom plate within a preset range in a first direction parallel to the first axis, and wherein the first cutting space is open outward along the first axis, and at least a portion of the sliding plate assembly passes through the first cutting space of the bottom plate.

2. The concrete cutting machine according to claim 1, wherein the sliding plate assembly comprises a supporting member connected to the bottom plate and movable relative to the bottom plate in the first direction parallel to the first axis and a flat member connected to the supporting member, the flat member has a flat surface parallel to the first axis, and the flat surface is located below the supporting member in a second direction perpendicular to the flat surface.

3. The concrete cutting machine according to claim 2, wherein the sliding plate assembly comprises a connecting assembly connecting the supporting member and the flat member, the connecting assembly comprises a biasing member which is elastically deformable in the second direction perpendicular to the flat surface, and one end of the biasing member abuts the flat member.

4. The concrete cutting machine according to claim 2, further comprising a rear wheel operably mounted to the bottom plate, wherein a lowest point of the rear wheel in the second direction perpendicular to the flat surface is located in a plane where the flat surface is located.

5. The concrete cutting machine according to claim 2, wherein the sliding plate assembly is capable of sliding relative to the bottom plate along a second direction perpendicular to the flat surface.

6. The concrete cutting machine according to claim 1, wherein the sliding plate assembly comprises a flat surface parallel to the first axis and the flat surface is located on a lower side of the bottom plate in a second direction perpendicular to the flat surface.

7. The concrete cutting machine according to claim 1, further comprising a mounting assembly configured to mount the sliding plate assembly to the bottom plate, wherein the mounting assembly is movably connected to the sliding plate assembly.

8. The concrete cutting machine according to claim 7, wherein the mounting assembly comprises a rotation operating member which is rotatably connected to the bottom plate and the sliding plate assembly separately, in response to the rotation operating member rotating about a second axis relative to the bottom plate, the sliding plate assembly moves relative to the bottom plate in a direction parallel to the second axis, and the second axis is parallel to the first axis.

9. The concrete cutting machine according to claim 8, wherein the mounting assembly further comprises a fastening member for connecting the bottom plate and the sliding plate assembly, the fastening member has a locked state and an unlocked state which are switchable, in response to the fastening member being in the locked state, the bottom plate is fixedly connected to the sliding plate assembly, in response to the fastening member being in the unlocked state, the bottom plate is movably connected to the sliding plate assembly, and the rotation operating member and the fastening member are respectively disposed at two ends of the sliding plate assembly in an extending direction of the sliding plate assembly.

10. The concrete cutting machine according to claim 7, wherein the mounting assembly further comprises a fastening member for fixing the bottom plate and the sliding plate assembly in a direction perpendicular to the first axis of the saw blade and the fastening member is movably connected to the bottom plate and the sliding plate assembly in a direction parallel to the first axis of the saw blade.

11. A concrete cutting machine, comprising:

a motor configured to drive a saw blade to rotate about a first axis;

a bottom plate configured to support the motor, wherein the bottom plate is formed with a first cutting space for the saw blade to pass through; and a sliding plate assembly comprising a member provided with a flat surface for contacting with concrete, wherein the flat surface is parallel to the first axis and the flat member provided with the flat surface is further provided with a second cutting space for the saw blade to pass through;

wherein the sliding plate assembly is detachably mounted to the bottom plate, the first cutting space is open outward along the first axis, and at least a portion of the sliding plate assembly passes through the first cutting space of the bottom plate in an up-down direction so that the flat surface is located below the bottom plate in a direction perpendicular to the flat surface.

* * * * *